United States Patent [19]

Komorita et al.

[11] Patent Number: 4,640,889

[45] Date of Patent: Feb. 3, 1987

[54] LIGHT-SENSITIVE SILVER HALIDE MULTI-LAYER COLOR PHOTOGRAPHIC MATERIAL

[75] Inventors: Kazuo Komorita; Masanobu Miyoshi; Kaoru Onodera, all of Odawara, Japan

[73] Assignee: Konishiroku Photo Industry Co., Ltd., Tokyo, Japan

[21] Appl. No.: 723,048

[22] Filed: Apr. 15, 1985

[30] Foreign Application Priority Data

Apr. 20, 1984 [JP] Japan ..... 59-80582

[51] Int. Cl.[4] ..... G03C 1/40; G03C 1/76

[52] U.S. Cl. ..... 430/505; 430/552; 430/553; 430/567

[58] Field of Search ..... 430/567, 505, 552, 553

[56] References Cited

U.S. PATENT DOCUMENTS

| | | | |
|---|---|---|---|
| 3,868,256 | 2/1975 | Sato et al. | 430/567 |
| 3,885,970 | 5/1975 | Miyahara | 430/567 |
| 3,989,527 | 11/1976 | Locker | 430/567 |
| 4,407,940 | 10/1983 | Nakamura et al. | 430/567 |
| 4,461,826 | 7/1984 | Yamashita et al. | 430/505 |
| 4,481,288 | 11/1984 | Yamada et al. | 430/567 |
| 4,528,263 | 7/1985 | Sugita et al. | 430/552 |

*Primary Examiner*—Won H. Louie

*Attorney, Agent, or Firm*—Frishauf, Holtz, Goodman & Woodward

[57] ABSTRACT

Disclosed is a light-sensitive silver halide multi-layer color photographic material having a light-sensitive silver halide emulsion layer combined with a non-diffusion coupler on a support, which comprises a light-sensitive silver halide emulsion layer farthest from the support which contains mono-dispersed silver halide grains comprising primarily (100) faces and having an average grain size of 0.2 to 0.8 μm.

The light-sensitive silver halide multi-layer color photographic material of the present invention has stable performance against fluctuations in developing processing conditions, has high sensitivity and low fogging.

12 Claims, No Drawings

LIGHT-SENSITIVE SILVER HALIDE MULTI-LAYER COLOR PHOTOGRAPHIC MATERIAL

BACKGROUND OF THE INVENTION

This invention relates to a light-sensitive silver halide multi-layer color photographic material, more particularly to a light-sensitive silver halide multi-layer color photographic material excellent in processing stability.

In recent years, continuous processing of color papers by means of an automatic developing machine has been generally practiced. In continuous processing by an automatic developing machine, in order to keep constant the components in the processing liquor, a supplemental system is employed. However, for the problem of economy as well as pollution, a concentrated-low-replenishment system has been increasingly employed for reducing the overflow liquors.

With respect to the concentrated-low-replenishment continuous processing by means of an automatic developing machine, there are involved various problems as mentioned below which deteriorate processing stability. For example, due to various causes such as entrainment of a bleach-fixing liquor into the color developing liquor due to so-called back-contamination, which is brought about by splashing within the processing machine and/or attachment on the conveying leader, belt, etc., or fluctuation in bromo ion density and pH in the color developing liquor due to the error in replenished amount, and further increase in chloro ion concentration in the color developing liquor according to the replenishment solution recovery system from the overflow liquor, there are involved problems such that fluctuation in sensitivity and gradation and increase of fog will readily occur.

According to our study, in the case of color paper, the red-sensitive emulsion layer which is the uppermost layer has been found to be susceptible to fluctuation by the processing liquor conditions.

Since increase of fog, changes in sensitivity and gradation accompanied with the fluctuation in the developing processing conditions will markedly lower the finishing quality of color print, it has been earnestly desired to stabilize developing processing.

For this purpose, it has been known in the art to incorporate various additives in the light-sensitive material for improvement of processing stability. For example, such additives may include nitrobenzimidazoles, mercaptothiazoles, benzotriazoles, nitrobenzotriazoles, mercaptotetrazoles, etc. as disclosed in U.S. Pat. No. 3,954,474 and No. 3,982,947, and Japanese Patent Publication No. 28660/1977.

It is also known to incorporate various additives in processing liquors for similar purposes. A typical example is diethylenetriaminepentaacetic acid as disclosed in Japanese Patent Publication No. 16861/1979.

However, the prior art technique involves the drawbacks such that the effect with respect to fluctuation in gradation and increase of fog is insufficient, that the photographic performance in the aspect of sensitivity is lowered and that storability of processing liquor is deteriorated.

Thus, under the present state of the art, various investigations have been made in color paper particularly as to means for improving processing stability of the red-sensitive emulsion existing as the uppermost layer.

SUMMARY OF THE INVENTION

Accordingly, an object of the present invention is to provide a light-sensitive silver halide color photographic material capable of providing stable performance against fluctuations in developing processing conditions, and it is also another object of the present invention to provide a light-sensitive silver halide color photographic material which is high in sensitivity and low in fogging. Other objects will become apparent from the following description.

The objects of the present invention can be accomplished by a light-sensitive silver halide multi-layer color photographic material having a light-sensitive silver halide emulsion layer combined with a non-diffusion coupler on a support, comprising a light-sensitive silver halide emulsion layer farthest from the support which contains mono-dispersed silver halide grains comprising primarily (100) faces and having an average grain size of 0.2 to 0.8 μm.

DESCRIPTION OF THE PREFERRED EMBODIMENTS

The mono-dispersed silver halide grains in the present invention refer to those having a value (hereinafter called to as CV) of the standard deviation S of the distribution of grain sizes (as shown below) divided by the average grain size $\bar{r}$ of 0.20 or less, preferably 0.15 or less.

$$S = \sqrt{\frac{\Sigma(\bar{r} - r_i)^2 n_i}{\Sigma n_i}}$$

The average grain size herein mentioned means an average value of diameters of spheres when silver halide grains are spherically shaped or diameters of spherical images calculated to have the same area as the projected images of the shapes other than spheres such as cubic bodies when they are in the form of such shapes, and $\bar{r}$ is defined by the following formula when individual grains have sizes of $r_i$ in number of $n_i$:

$$\bar{r} = \frac{\Sigma n_i r_i}{\Sigma n_i}$$

The above grain size may be measured for the above purpose according to various methods generally employed in this field of the art. Typical methods are described in Rubland "Grain size analytical method", A.S.T.M. Symposium On Light Microscopy, 1955, pp. 94–122 or "Theory of Photographic Process" by Mees and James, Third Edition, published by Mcmillan Co. (1966), Chapter 2. The grain size can be measured by use of the projected area or the approximate value of diameter. When the grains are substantially uniform in shape, the grain size distribution can be represented considurably accurately as the diameter or the projected area.

The silver halide grains comprising primarily (100) faces to be used in the light-sensitive silver halide emulsion layer fartheset from the support in this invention have a average grain size within the range of from 0.2 to 0.8 μm. If the average grain size is smaller than 0.2 μm, the gradation change and increase in fogging are greater with fluctuations in developing processing conditions.

On the other hand with a average grain size greater than 0.8 μm, other problems will ensue such as lowering in progress of development and, particularly in the case of color paper, worsening in color separation through increase in inherent sensitivity. The range of average grain size may preferably be from 0.25 to 0.6 μm. The average grain size can be measured according to the method as mentioned above.

In this invention, it is preferred that the grain of the mono-dispersed silver halide emulsion is a normal crystal grain.

The mono-dispersed silver halide grains to be used in the light-sensitive silver halide emulsion layer farthest from the support in this invention have crystal habits comprising primarily (100) faces. The silver halide grains having crystal habits primarily (100) faces are preferably cubic grains and/or tetradecahedral grains, more preferably silver halide grains satisfying $5 \leqq K \leqq 500$ wherein K={intensity of diffracted ray attributable to (200) face}/{intensity of diffracted ray attributable to (222) face} which is measured according to the X-ray diffraction analytical method as described in Japanese Provisional Patent Publication No. 29243/1984 and "Bulletin of the Society of Scientific Photography of Japan, No. 13, December, 1963".

In the present invention, such mono-dispersed silver halide grains constitute at least 50% by weight (preferably at least 75% by weight) of the total silver halide grains contained in the light-sensitive silver halide emulsion layer farthest from the support.

The silver halide emulsion containing mono-dispersed silver halide emulsions according to this invention can be prepared by applying the method as disclosed in Japanese Provisional Patent Publication No. 48521/1979. Namely, it can be prepared according to the method wherein an aqueous potassium chlorobromide-gelatin solution and an aqueous ammoniacal silver nitrate solution are added into an aqueous gelatin solution containing silver halide seed grains by changing the addition rate as a function of time. In carrying out this method, by suitable choice of the time function for addition rate, pAg and temperature, a highly mono-dispersed silver halide emulsion can be obtained. The silver halide grains may have a structure either uniform from the inner portion to the outer portion or an equal structure in which the inner portion and the outer portion are different in nature. More specifically, the mono-dispersed emulsion of the present invention can be prepared by the following method.

Namely, in the method of preparing silver bromide and silver iodobromide crystals for light-sensitive photographic material by simultaneously adding a silver salt aqueous solution and a halide salt aqueous solution in the presence of a protective colloid and reacting (double jet method) them to grow up seed crystals, it can be prepared by a method of adding each of the above two kinds of aqueous solutions at an addition speed of from Q (mole/min) represented by the following formula to not less than 50% of said addition speed Q.

$$Q = \left\{ \left( \frac{\bar{x} + y}{\bar{x}} \right)^3 - 1 \right\} \times (m_0 + m)$$

wherein $\bar{x}$ is a grain size of growing up crystals (μm), $m_0$ is an amount (mole) of seed crystals initially added, m is a total amount (mole) of an added silver salt aqueous solution, and y is represented by the following formula:

$$y = 10\{fa(I) + fb(pAg) + fc(CNH_3) + fd(r,\bar{x})\}$$

wherein $fa(I) = a_0 + a_1 I$, $$fb(pAg) = b_0 + b_1(pAg) + b_2(pAg)^2 + b_3(pAg)^3 + b_4(pAg)^4 + b_5(bAg)^5,$$

$$fc(CNH_3) = C_1/(CNH_3 + C_0) + c_2,$$

$$fd(r,x) = d_0 + d_1(r - x + 0.5) + d_2(r - x + 0.5)^2 + d_3 \log \bar{x}$$

In the above formulae, I represents iodine content of silver iodobromide (mole percent), pAg represents a logarithm of a silver ion concentration in the reaction solution, $CNH_3$ represents a concentration of ammonia (mole/l) in the reaction solution, and r represents an average distance (μm) between grains of growing crystals. Further, $a_0$, $a_1$, $b_0$, $b_1$, $b_2$, $b_3$, $b_4$, $b_5$, $c_0$, $c_1$, $c_2$, $d_0$, $d_1$, $d_2$, and $d_3$ are numerals shown in the following table.

| | |
|---|---|
| $a_0$ | +0.07938 |
| $a_1$ | −0.01323 |
| $b_0$ | +4178.9825 |
| $b_1$ | −2831.27994 |
| $b_2$ | +762.55901 |
| $b_3$ | −102.086248 |
| $b_4$ | +6.7915594 |
| $b_5$ | −0.1795947 |
| $c_0$ | +0.15 |
| $c_1$ | −0.2146 |
| $c_2$ | +1.4307 |
| $d_0$ | +0.6342 |
| $d_1$ | −0.4590 |
| $d_2$ | +0.04765 |
| $d_3$ | −0.5669 |

However, one may of course utilize a conventional double jet method.

Also, they can be either of the type which forms latent images primarily on the surfaces or of the type which forms latent images within the inner portion of the grains.

The silver halide composition in the light-sensitive silver halide emulsion layer farthest from the support in this invention may be any of silver chloride, silver bromide, silver iodide, further silver chlorobromide, silver iodobromide and silver chloroiodobromide, particularly preferably a silver chlorobromide containing 25 mole or more of silver bromide when applied for a color paper.

The layer structure in the light-sensitive silver halide multi-layer color photographic material according to this invention may take any desired form. When any kind of layer structure may be employed for this invention, the objects of this invention can be accomplished by the use of a silver haide emulsion layer farthest from the support, which contains mono-dispersed silver halide grains with an average grain size of 0.2 to 0.8 μm comprising primarily (100) faces in an amount of at least 50% by weight (preferably 75% by weight or more) of the total silver halide grains contained in said emulsion layer. Further, it is also preferred to use the embodiment of a multi-layer color paper in which a blue-sensitive silver halide emulsion layer, a green-sensitive silver halide emulsion layer and a red-sensitive silver halide emulsion layer in the order nearer to the support are provided.

The support to be used in the light-sensitive material of this invention is not particularly limited, but preferably include baryta paper, polyethylene-coated paper, polypropylene synthetic paper, glass paper, cellulose acetate, cellulose nitrate, polyvinyl acetal, polypropylene, polyester film such as polyethylene terephthalate, polystyrene, etc. Particularly preferred is a polyethylene-coated paper or a polypropylene synthetic paper. These supports may be chosen suitably depending on the intended uses of the respective light-sensitive materials.

These supports may be applied with subbing treatments, if desired.

As the non-diffusion coupler to be used in the light-sensitive material of this invention, it is possible to use those conventionally used in this field of the art. As the non-diffusion coupler to be combined with the silver halide emulsion layer farthest from the support, although different depending on the layer construction, it is a general practice to combine a cyan coupler when the emulsion layer is red-sensitive, a magenta coupler when it is green-sensitive and a yellow coupler when it is blue-sensitive. As the yellow coupler, there may be used known open-chain ketomethylene type couplers. Among them, benzoylacetanilide type compounds and pivaloylacetanilide type compounds are useful.

As the magenta coupler, pyrazolone type compounds, indazolone type compounds and cyanoacetyl type compounds may be available, and as the cyan coupler, phenol type compounds and naphthol type compounds.

When the present invention is applied for a color paper, it is preferred that the light-sensitive silver halide emulsion layer farthest from the support should be red-sensitive and the non-diffusion coupler contained in said layer should preferably a cyan coupler.

The non-diffusion coupler to be used in the light-sensitive material of the present invention should preferably be a phenol type cyan coupler, most preferably a cyan coupler represented by the formula [I] shown below:

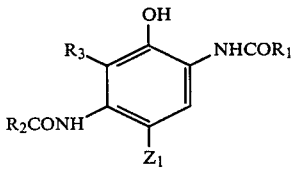

[I]

wherein $R_1$ represents an aryl group, a cycloalkyl group or a heterocyclic group; $R_2$ represents an alkyl group or a phenyl group; $R_3$ represents a hydrogen atom, a halogen atom, an alkyl group or an alkoxy group; $Z_1$ represents a hydrogen atom, a halogen atom or an eliminable group through the reaction with the oxidized product of an aromatic primary amine type color developing agent.

The aryl group represented by $R_1$ may be, for example, a phenyl group, or a naphthyl group, preferably a phenyl group. The heterocyclic group represented by $R_1$ may be, for example, a pyridyl group, a furan group, etc. The cycloalkyl group represented by $R_1$ may be, for example, a cyclopropyl group, a cyclohexyl group, etc. The groups represented by these $R_1$ may have a single or a plurality of substituents. For example, typical examples of substituents to be introduced into the phenyl group may include a halogen atom (e.g. fluorine, chlorine, bromine, etc.), an alkyl group (e.g. a methyl group, an ethyl group, a propyl group, a butyl group, a dodecyl group, etc.), a hydroxyl group, a cyano group, a nitro group, an alkoxy group (e.g. a methoxy group, an ethoxy group, etc.), an alkylsulfonamide group (e.g. methylsulfonamide group, an octylsulfonamide group, etc.), an arylsulfonamide group (e.g. a phenylsulfonamide group, a naphthylsulfonamide group, etc.), an alkylsulfamoyl group (e.g. a butylsulfamoyl group, etc.), an arylsulfamoyl group (e.g. a phenylsulfamoyl group, etc.), an alkyloxycarbonyl group (e.g. a methyloxycarbonyl group, etc.), an aryloxycarbonyl group (e.g. a phenyloxycarbonyl group, etc.), an aminosulfonamide group, an acylamino group, a carbamoyl group, a sulfonyl group, a sulfinyl group, a sulfoxy group, a sulfo group, an aryloxy group, an alkoxy group, a carboxyl group, an alkylcarbonyl group, an arylcarbonyl group, an aminocarbonyl group and so on. Two or more kinds of these substituents may also be substituted on the phenyl group. The preferable group represented by $R_1$ may be a phenyl group or a phenyl group having one or two or more substituents of a halogen atom, an alkylsulfonamide group, an arylsulfonamide group, an alkylsulfamoyl group, an arylsulfamoyl group, an alkylsulfonyl group, an arylsulfonyl group, an alkylcarbonyl group, an arylcarbonyl group or a cyano group.

The alkyl group represented by $R_2$ may be either straight or branched, such as a methyl group, an ethyl group, a propyl group, a butyl group, an octyl group and the like.

In the following, typical examples of the cyan couplers represented by the above formula [I] are shown.

(I-1)

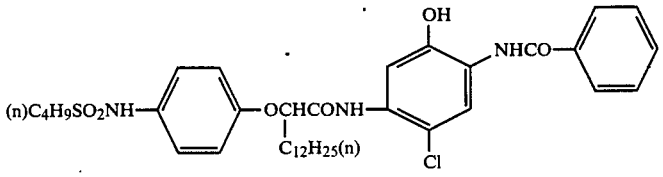

-continued
(I-2)
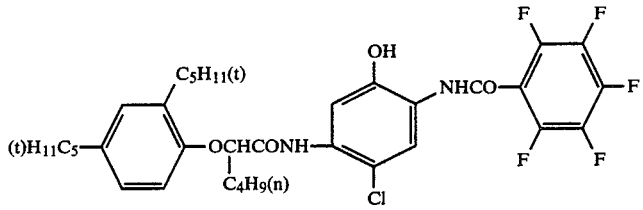
(I-3)
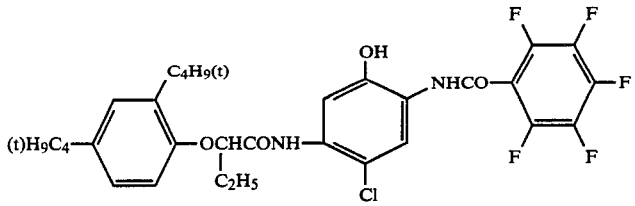
(I-4)
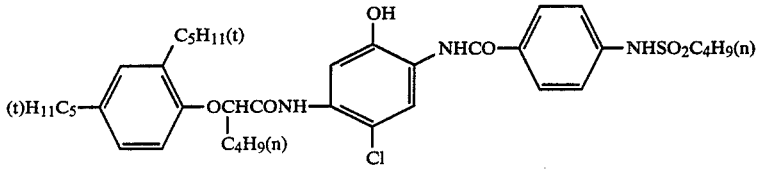
(I-5)
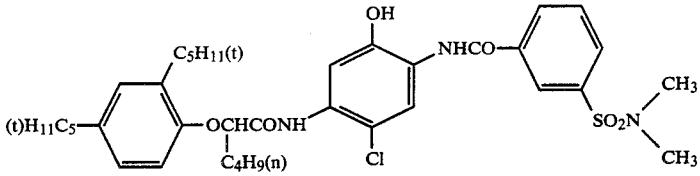
(I-6)
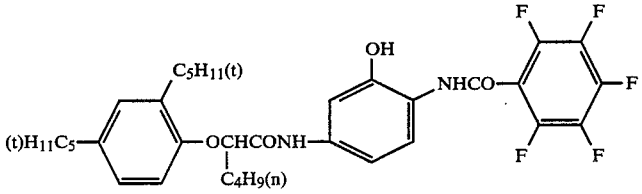
(I-7)
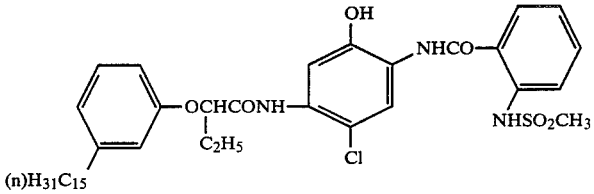
(I-8)
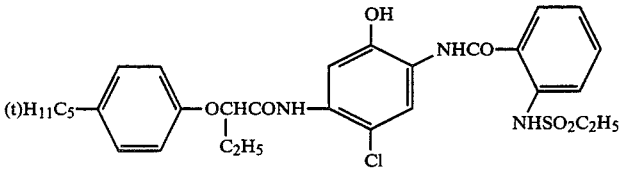
(I-9)
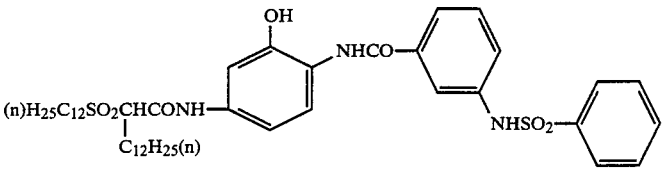

-continued (I-10)

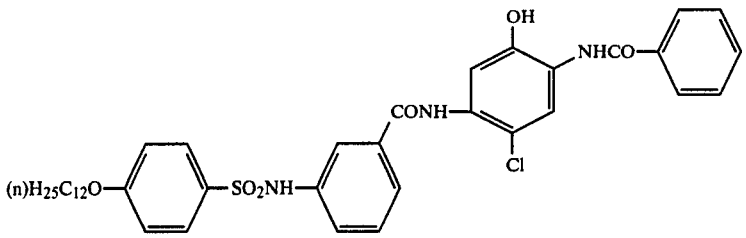

(I-11)

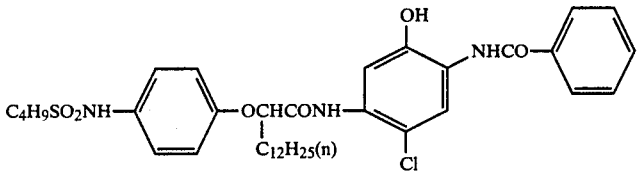

(I-12)

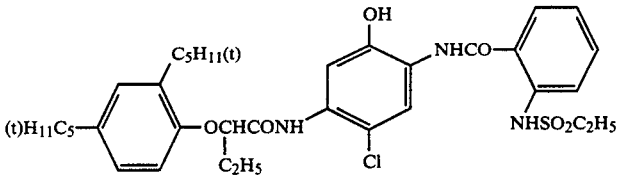

The coupler represented by the formula [I] may be used either alone or in combination with other cyan couplers.

Particularly, when a cyan coupler represented by the formula [I] is used, the effect of the present invention can be further enhanced and the color restorability in the bleach-fixing processing can be improved to increase overall processing stability.

The cyan coupler represented by the formula [I] can be incorporated in the emulsion according to a conventional method.

The silver halide grains according to the present invention can be applied with various kinds of chemical sensitizing method generally applied. For example, chemical sensitization can be achieved by using singly or in combination with chemical sensitizers such as active gelatin; noble metal sensitizers such as water-soluble gold salts, water-soluble platinum salts, water-soluble palladium salts, water-soluble rhodium salts, water-soluble iridium salts, etc.; sulfur sensitizers; selenium sensitizers; reducing sensitizers such as polyamine, stannous chloride, etc.

The emulsion containing silver halide grains according to the present invention can be sensitized optically to a desired wavelength region. The method for optical sensitization of the silver halilde emulsion according to the present invention is not particularly limited, but optical sensitizers, for example, cyanine dyes such as zeromethyne dyes, monomethyne dyes, dimethyne dyes and trimethyne dyes or merocyanine dyes may be used either alone or in combination (e.g. color super sensitization) to effect optical sensitization. These techniques are disclosed in U.S. Pat. Nos. 2,688,545, 2,912,329, 3,397,060, 3,615,635 and 3,628,964; U.K. Pat. Nos. 1,195,302, 1,242,588 and 1,293,862; German Pat. (OLS) Nos. 2,030,325 and 2,121,780; and Japanese Patent Publications No. 4936/1968 and No. 14030/1969, etc. The sensitizers may be chosen as desired depending on the purpose and use of the light-sensitive silver halide photographic material such as the wavelength region to be sensitized, sensitivity, etc.

The silver halide emulsion according to this invention can contain various additives conventionally used depending on its purposes. These additives may include, for example, stabilizers or antifoggants such as azaindenes, triazoles, tetrazoles, imidazolium salts, tetrazolium salts, polyhydroxy compounds, etc.; film hardeners such as aldehyde type, aziridine type, inoxazole type, vinyl sulfone type, acryloyl type, adipodiimide type, maleimide type, methanesulfonic acid ester type, triazine type, etc.; developing accelerators such as benzyl alcohol, polyoxyethyelene type compounds, etc.; image stabilizers such as couromane type, cumarane type, bisphenol type, phosphite type; lubricants such as wax, glycerides of higher fatty acids, higher alcohol esters of higher fatty acids. Also, as surfactants, for coating aids, agents for improving penetrability for processing liquors, defoaming agents or various materials for controlling various physical properties of the light-sensitive material, various kinds of surfactants of anionic, cationic, nonionic or amphoteric can be used. As the antistatic agents, diacetyl cellulose, styrene-perfluoroalkyl sodium maleate copolymer, alkali salts of the reaction product of styrene-maleic anhydride copolymer with p-aminobenzenesulfonic acid, etc. may be effective. The matting agent may include polymethylmethacrylate, polystyrene and alkali soluble polymers. Also, use of colloidal silicon oxide may be possible. As the latex to be added for improvement of film properties, there may be employed copolymers of acrylates or vinyl esters with monomers having other ethylenic groups. The gelatin plasticizer may include glycerine and glycolic compounds, and the thickener may include styrene-sodium maleate copolymer, alkylvinyl ether-maleic acid copolymer, etc.

The light-sensitive photographic material according to this invention can be developed according to a known method conventionally used after exposure. When the light-sensitive photographic material is for color, it can be color developed according to the color developing method conventionally used. In the reversal method, first developing is carried out with a black-and-white negative developing solution, subsequently white color exposure is given or processing in a bath containing a fogging agent is conducted, followed further by color developing with an alkali developing solution containing a color developing agent. The processing methods are not particularly limited, but all of the processing methods are applicable. For example, it is possible to apply a system in which, after color developing, bleach-fixing processing is performed, and if desired, followed further by washing with water and stabilizing processing, or after color developing, bleaching and fixing are performed separately, and if desired, followed further by washing with water and stabilizing processing.

This invention is described in detail by referring to the following Examples, by which the present invention is not limited.

EXAMPLE 1

According to the double jet method as described in Japanese Provisional Patent Publication No. 48521/1979 and controlling the pAg, an octahedral mono-dispersed emulsion (called Emulsion A) and a cubic mono-dispersed emulsion (called Emulsion B) and further three kinds of tetradecahedral mono-dispersed emulsion with different ratios of (100) face and (111) face (called Emulsions C, D and E) of each silver chlorobromide (each containing 80 mole % of silver bromide) with an average grain size of 0.4 μm were prepared, respectively. Further, according to the method of the prior art, a sulfur sensitizer, a red-sensitive sensitizing dye and a stabilizer were added to prepare a red-sensitive silver chlorobromide emulsion.

Next, the following layers were provided by coating successively on a paper support applied with a resin coating to prepare a light-sensitive silver halide multilayer photographic material (Incidentally, the amount of each material which has been used in the respective layer is shown as weight (mg) per $dm^2$):

(1) Blue-sensitive silver halide emulsion layer containing a yellow coupler A (7.8 mg) shown below, a blue-sensitive silver chlorobromide (octahedral mono-dispersed ($S/\bar{r}=0.12$) emulsion having average grain size 0.8 μm which was prepared by the same manner as mentioned above, 4.0 mg calculated on silver) and 20 mg of gelatin;

(2) Intermediate layer containing 0.2 mg of dioctylhydroquinone and 10 mg of gelatin;

(3) Green-sensitive silver halide emulsion layer containing a magenta coupler B (4.2 mg) shown below, a green-sensitive silver chlorobromide emulsion (octahedral mono-dispersed ($S/\bar{r}=0.12$) emulsion having average grain size 0.5 μm which was prepared by the same manner as mentioned above, 3.7 mg calculated on silver) and 20 mg of gelatin;

(4) Intermediate layer containing 0.3 mg of dioctylhydroquinone and 15 mg of gelatin;

(5) Red-sensitive silver halide emulsion layer containing a cyan coupler C (3.2 mg) shown below, a red-sensitive silver chlorobromide emulsion (average grain size 0.35 μm, 3.0 mg calculated on silver) and 15 mg of gelatin;

(6) Gelatin protective layer containing 10 mg of gelatin.

Yellow coupler A:

-continued

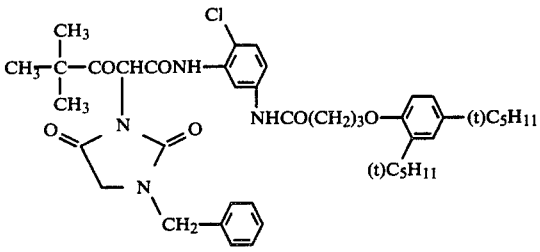

Magenta coupler B:

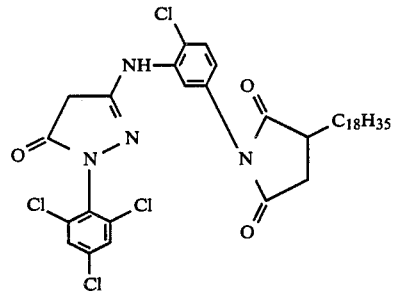

Cyan coupler C:

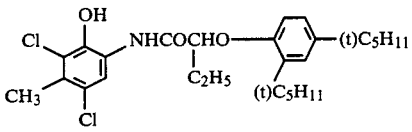

As the above red-sensitive silver chlorobromide emulsions, 5 kinds of emulsions were prepared by use of Emulsions A to E to prepare Samples No. 1 to No. 5.

The five kinds of the coated samples were exposed to white light through an optical wedge by means of a sensitometer (KS-7 Model produced by Konishiroku Photo Industry Co.), and then processings were applied following the processing steps shown below.

| [Processing step] | Processing time | Temperature |
|---|---|---|
| Color developing | 3.5 min. | 33° C. |
| Bleach-fixing | 1.5 min. | 33° C. |
| Water washing | 3 min. | 33° C. |
| Drying | — | 80° C. |
| [Color developing solution No. 1] | | |
| Pure water | | 700 ml |
| Benzyl alcohol | | 15 ml |
| Diethylene glycol | | 15 ml |
| Hydroxyamine sulfate | | 2 g |
| 3-Methyl-4-amino-N—ethyl-N—(β-methanesulfonamidoethyl)-aniline sulfate | | 4.4 g |
| Potassium carbonate | | 30 g |
| Potassium bromide | | 0.4 g |
| Potassium chloride | | 0.5 g |
| Potassium sulfite | | 2 g |
| made up to one liter with addition of pure water (pH = 10.2). | | |
| [Bleach-fixing solution No. 1] | | |
| Ferric ammonium ethylenediaminetetraacetate | | 61 g |
| Diammonium ethylenediaminetetraacetate | | 5 g |
| Ammonium thiosulfate | | 125 g |
| Sodium metabisulfite | | 13 g |
| Sodium sulfite | | 2.7 g |
| made up to one liter with addition of pure water (pH = 7.2). | | |

In carrying out developing with color developing solution No. 2, the compounds as shown in Table 1 were further added to the color developing solution No. 1 for comparative development.

TABLE 1

| Color developing solution No. | Composition |
|---|---|
| 1 | as described above |
| 2 | Color developing liquor No. 1 to which 1.0 g of potassium bromide is added |

Each of the samples obtained by processing was measured by means of an optical densitometer (PDA-60 Model, produced by Konishiroku Photo Industry Co.) to determine the gamma value for densities from 0.8 to 1.8. The results are shown in Table 2 below.

TABLE 2

| Sample No. | Emulsion used | X-ray diffraction peak ratio K (200)/(222) | CV (S/r̄) | Color developing solution No. 1 Red-sensitive layer γ | Green-sensitive layer γ | Blue-sensitive layer γ | Color developing solution No. 2 Red-sensitive layer γ | Green-sensitive layer γ | Blue-sensitive layer γ |
|---|---|---|---|---|---|---|---|---|---|
| 11 | A | 0.12 | 0.12 | 3.21 | 3.36 | 3.04 | 4.25 | 3.51 | 3.20 |
| 12 (This invention) | B | 1512 | 0.12 | 3.35 | 3.39 | 3.06 | 3.82 | 3.48 | 3.22 |
| 13 (This invention) | C | 324 | 0.12 | 3.29 | 3.38 | 3.05 | 3.59 | 3.50 | 3.22 |
| 14 (This invention) | D | 68 | 0.12 | 3.27 | 3.41 | 3.05 | 3.56 | 3.49 | 3.21 |
| 15 (This invention) | E | 10 | 0.12 | 3.30 | 3.37 | 3.01 | 3.61 | 3.49 | 3.19 |

As apparently seen from Table 2, the red-sensitive layer of the uppermost layer is most susceptible to influence by increase of potassium bromide, and fluctuation of gamma values in red-sensitive layers can be improved to great extent in Samples No. 12, No. 13, No. 14 and No. 15 according to the present invention. Particularly, in Samples No. 13 to No. 15, fluctuation of gamma values of the red-sensitive layer is low whereby it is understood that these samples have excellent photographic properties.

EXAMPLE 2

The same samples as in Example 1 were exposed to light and processed in the same manner as in Example 1, except that the color developing liquors as shown in Table 3 were employed.

TABLE 3

| Color developing solution No. | Composition |
|---|---|
| 3 | Color developing solution No. 1 to which KOH is added to adjust pH 10.8 |
| 4 | Color developing solution No. 1 to which 1.0 ml of bleach-fixing liquor No. 1 is added |

For the samples obtained, fog and gamma value of the red-sensitive layer were measured similarly as in Example 1. The results are shown in Table 4.

TABLE 4

| Sample No. | Gamma Color developing solution No. 1 | No. 3 | No. 4 | Fog Color developing solution No. 1 | No. 3 | No. 4 |
|---|---|---|---|---|---|---|
| 11 | 3.21 | 4.21 | 4.42 | 0.05 | 0.09 | 0.10 |
| 12 (This invention) | 3.35 | 3.89 | 4.01 | 0.05 | 0.08 | 0.08 |
| 13 (This invention) | 3.29 | 3.57 | 3.65 | 0.05 | 0.06 | 0.06 |
| 14 (This invention) | 3.29 | 3.59 | 3.63 | 0.05 | 0.06 | 0.06 |
| 15 (This invention) | 3.30 | 3.70 | 3.75 | 0.05 | 0.06 | 0.06 |

As apparently seen from Table 4, even in the case of increase of pH and contamination of bleach-fixing liquor, Samples No. 12 to No. 15 according to the present invention show excellent processing stability. Particularly, in Samples No. 13 to No. 15, fluctuation of gamma values is low and fog thereof is also low whereby it is understood that these samples have excellent photographic properties.

EXAMPLE 3

According to the same method as in Example 1, tetradecahedral mono-dispersed (s/r̄=0.10) emulsions of silver chlorobromide (containing 70 mole % of silver bromide) with average grain sizes of 0.15 μm, 0.3 μm, 0.6 μm and 0.9 μm (these are called Emulsions F, G, H and I), and further a tetradecahedral poly-dispersed (s/r̄=0.28) emulsion (which was prepared by double-jet method without controlling addition speed) with average grain size of 0.3 μm (called Emulsion J) were prepared and red-sensitive silver chlorobromide emulsions were obtained similarly as in Example 1. Next, light-sensitive silver halide multi-layer color photographic materials were prepared similarly as in Example 1. Light exposure, processing and measurement were conducted in the same manner as in Example 1. The results of the red-sensitive layers obtained are shown in Table 5.

TABLE 5

| Sample No. | Emulsion used | X-ray diffraction peak ratio K (200)/(222) | Gamma (γ) Color developing solution No. 1 | Gamma (γ) Color developing solution No. 2 |
|---|---|---|---|---|
| 31 | F | 69 | 3.16 | 4.01 |
| 32 (This invention) | G | 72 | 3.21 | 3.52 |
| 33 (This invention) | H | 71 | 3.18 | 3.51 |
| 34 | I | 73 | 3.02 | 3.39 |
| 35 | J | 74 | 2.90 | 3.82 |

As apparently seen from Table 5, the samples of this invention No. 32 and No. 33 are small in fluctuation of gamma values, but the sample No. 31 outside the scope of the average grain size of the present invention and the sample No. 35 of the poly-dispersed emulsion are great in fluctuation of gammm values. As for the sample No. 34, gamma value is low even in comparative processing due to deterioration in developing characteristic, and color turbidity also occurred due to increase in inherent sensitivity. Thus, it is not suitable for practical appliction.

EXAMPLE 4

By use of the Emulsions B and D prepared in Example 1, the samples were prepared, exposed, processed and measured, similarly as in Example 1, by varying the cyan couplers as shown in Table 6. The results obtained are shown in Table 6.

C: Cyan couplers employed in Example 1

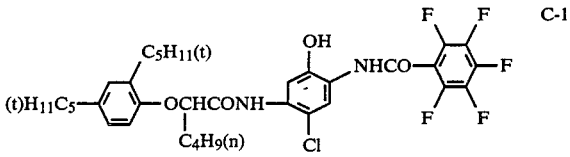

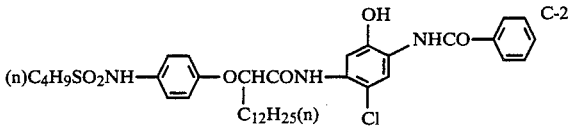

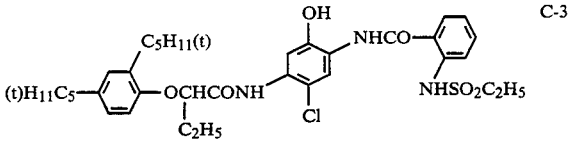

TABLE 6

| Sample No. | Emulsion used | Cyan coupler | Color developing solution No. 1 | Color developing solution No. 2 |
|---|---|---|---|---|
| 41 | B | C | 3.35 | 3.82 |
| 42 | B | C-1 | 3.29 | 3.44 |
| 43 | B | C-2 | 3.31 | 3.46 |
| 44 | B | C-3 | 3.28 | 3.44 |
| 45 | D | C | 3.27 | 3.56 |
| 46 | D | C-1 | 3.32 | 3.40 |
| 47 | D | C-2 | 3.30 | 3.39 |
| 48 | D | C-3 | 3.28 | 3.38 |

As is apparent from Table 6, all the samples have good properties. Especially, Samples No. 42 to No. 44 and No. 46 to No. 48 have superior properties by use of cyan couplers represented by the formula [I] as compared with Samples No. 41 and No. 45 which were used comparative cyan coupler C.

We claim:

1. A light-sensitive silver halide multi-layer color photographic material having a light-sensitive silver halide emulsion layer on a support, comprising a red-light-sensitive silver halide emulsion layer, a green-light-sensitive silver halide emulsion layer and a blue-light-sensitive silver halide emulsion layer, said red-light-sensitive silver halide emulsion layer being the light-sensitive silver halide emulsion layer farthest from the support and containing mono-dispersed silver halide grains comprising primarily (100) faces and having an average grain size of 0.2 to 0.8μ and a non-diffusion cyan coupler represented by the formula:

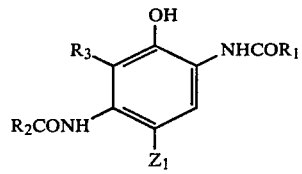

wherein $R_1$ represents an aryl group, a cycloalkyl group or a heterocyclic group; $R_2$ represents an alkyl group or a phenyl group; $R_3$ represents a hydrogen atom, a halogen atom, an alkyl group or an alkoxy group; $Z_1$ represents a hydrogen atom, a halogen atom or an eliminable group through the reaction with the oxidized product of an aromatic primary amine type color developing agent.

2. A light-sensitive silver halide multi-layer color photographic material according to claim 1, wherein said mono-dispersed silver halide grains have a value of the standard deviation S of the distribution of grain sizes divided by the average grain size $\bar{r}$ of 0.20 or less.

3. A light-sensitive silver halide multi-layer color photographic material according to claim 2, wherein said mono-dispersed silver halide grains have a value of the standard deviation S of the distribution of grain sizes divided by the average grain size $\bar{r}$ of 0.15 or less.

4. A light-sensitive silver halide multi-layer color photographic material according to claim 1, wherein the range of an average grain size of said mono-dispersed silver halide grains is from 0.25 to 0.6 μm.

5. A light-sensitive silver halide multi-layer color photographic material according to claim 1, wherein crystal habits of said mono-dispersed silver halide grains are cubic grains and/or tetradecahedral grains.

6. A light-sensitive silver halide multi-layer color photographic material according to claim 1, wherein said mono-dispersed silver halide grains satisfy the relation of $5 \leqq K \leqq 500$ wherein K={intensity of diffracted ray attributable to (200) face}/{intensity of diffracted ray attributable to (222) face} which is measured according to the X-ray diffraction analytical method.

7. A light-sensitive silver halide multi-layer color photographic material according to claim 1, wherein said mono-dispersed silver halide grains constitute at least 50% by weight of the total silver halide grains contained in the light-sensitive silver halide emulsion layer farthest from the support.

8. A light-sensitive silver halide multi-layer color photographic material according to claim 7, wherein said mono-dispersed silver halide grains constitute at least 75% by weight of the total silver halide grains contained in the light-sensitive silver halide emulsion layer farthest from the support.

9. A light-sensitive silver halide multi-layer color photographic material according to claim 1, wherein said cyan coupler is a compound represented by the formula:

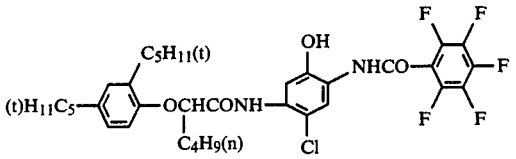

10. A light-sensitive silver halide multi-layer color photographic material according to claim 1, wherein said cyan coupler is a compound represented by the formula:

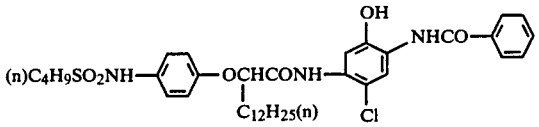

11. A light-sensitive silver halide multi-layer color photographic material according to claim 1, wherein said cyan coupler is a compound represented by the formula:

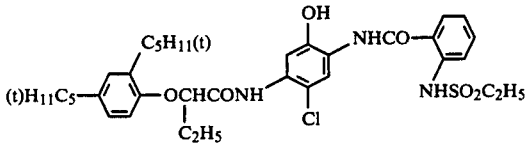

12. A light-sensitive silver halide multi-layer color photographic material according to claim 1, wherein said mono-dispersed silver halide grains are grains of silver chlorobromide containing 25 mole or more of silver bromide.

* * * * *